United States Patent [19]

Gooch

[11] 4,206,675

[45] Jun. 10, 1980

[54] CYBERNETIC MUSIC SYSTEM

[76] Inventor: Sherwin J. Gooch, 813 Fairview, Urbana, Ill. 61801

[21] Appl. No.: 773,078

[22] Filed: Feb. 28, 1977

[51] Int. Cl.[2] ..... G10F 1/00

[52] U.S. Cl. ..... 84/1.03; 84/470 R; 35/6

[58] Field of Search ..... 84/DIG. 8, 470, 1.01, 84/1.03; 35/5, 6

[56] References Cited

U.S. PATENT DOCUMENTS

| | | | |
|---|---|---|---|
| 3,724,097 | 4/1973 | Schmoyer | 35/6 |
| 3,952,624 | 4/1976 | Kawamaki | 84/DIG. 8 |

*Primary Examiner*—Gene Z. Rubinson
*Assistant Examiner*—L. W. Pojunas, Jr.
*Attorney, Agent, or Firm*—Mathew L. Kalinowski

[57] ABSTRACT

A cybernetic music system is provided that comprises digitized music-information input capable of transmitting in real time the required music information over a narrow bandwidth channel. The system includes a peripheral music synthesizer and audio output means and is capable of reproducing the music information aurally in at least four voices. The peripheral music synthesizer comprises control circuitry, voice logic circuitry, and volume control circuitry. The system is particularly useful for individualized student instruction in and composition of music.

2 Claims, 7 Drawing Figures

CYBERNETIC MUSIC SYSTEM

This invention relates to a cybernetic music system. More particularly this invention relates to a music system combination including a central computer containing music information, which is linked by a narrow bandwidth channel, such as a telephone line, to a user terminal having a keyset similar to that of a typewriter for constructing and executing the desired music information. A peripheral music synthesizer is coupled to this system and to audio output means. The system is capable of reproducing music aurally in at least four voices.

Computer systems containing educational information including music information are well known in the art. A particularly useful embodiment of such systems is the PLATO System operated in conjunction with a PLATO user terminal (PLATO is an acronym for Programmed Logic for Automatic Teaching Operations). The PLATO System is described in detail in U.S. Pat. No. 3,405,457; U.S. Pat. No. 3,559,190; and U.S. Pat. No. 3,911,417 which patents are incorporated herein by reference.

DESCRIPTION OF DRAWINGS

The drawings depict electronic circuitry suitable for use in the music synthesizer.

DETAILED DESCRIPTION OF THE INVENTION

Figure 1A:
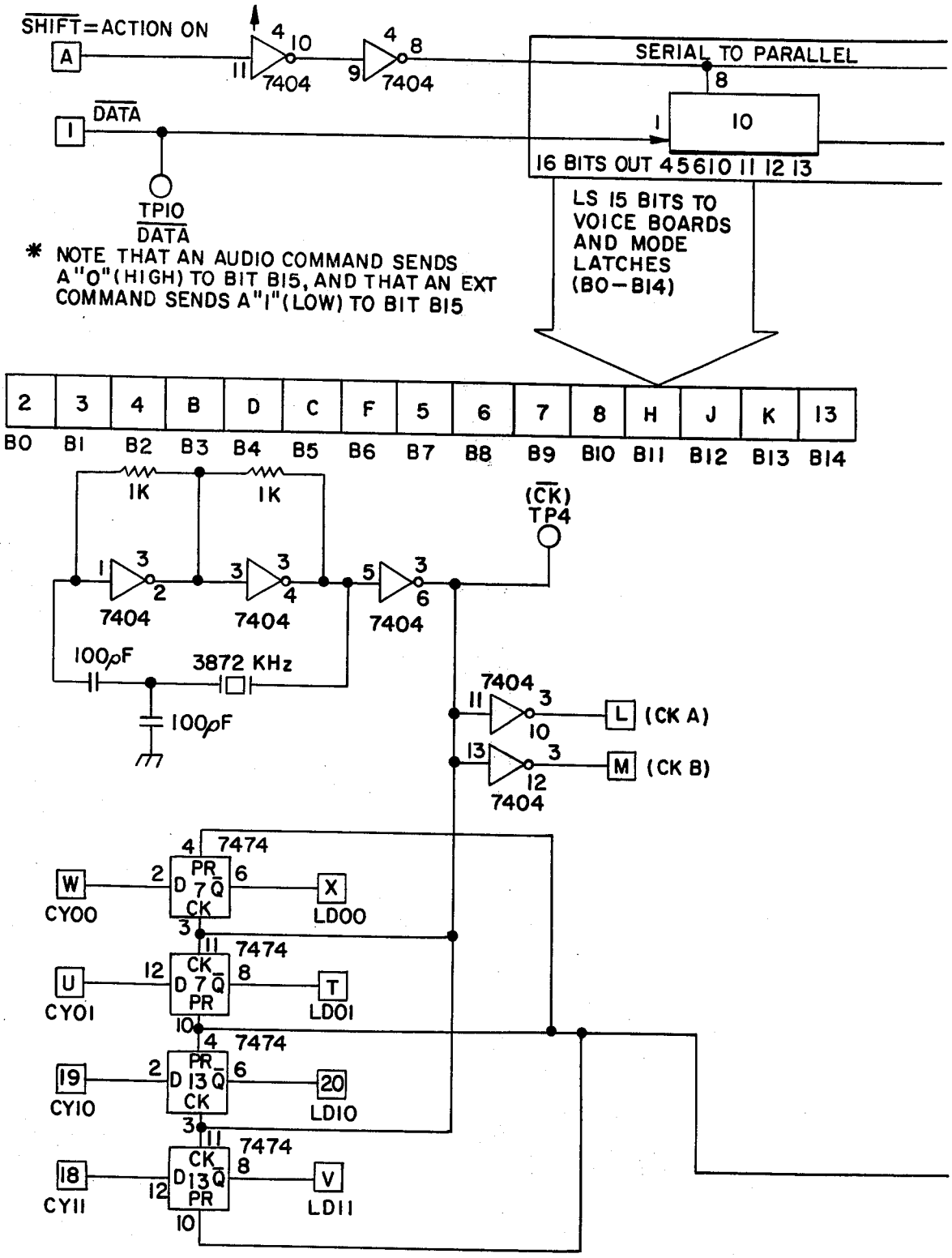
FIGS. 1A and 1B are schematic drawings of suitable control circuitry.
Figure 1B:
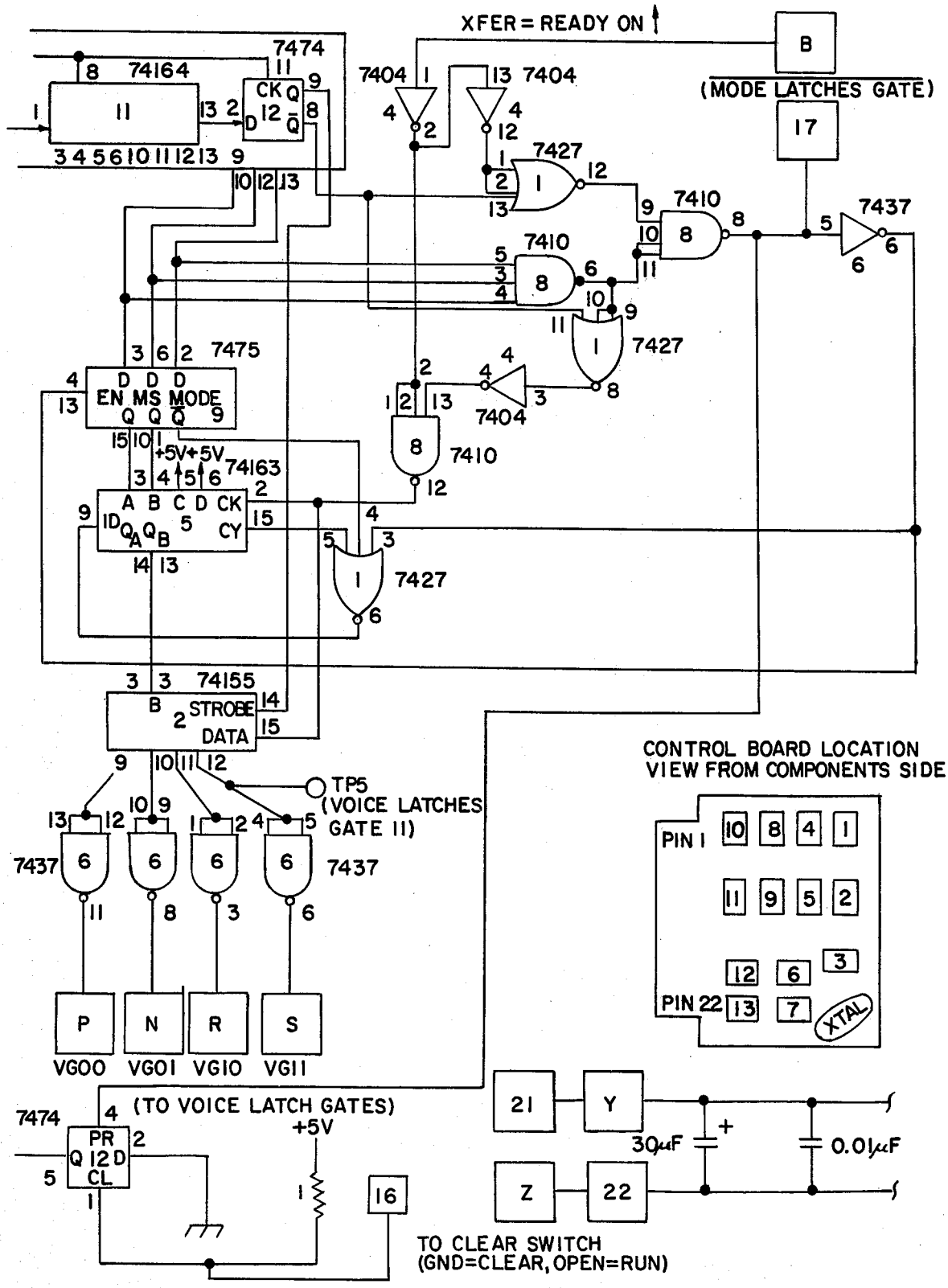
Figure 2A:
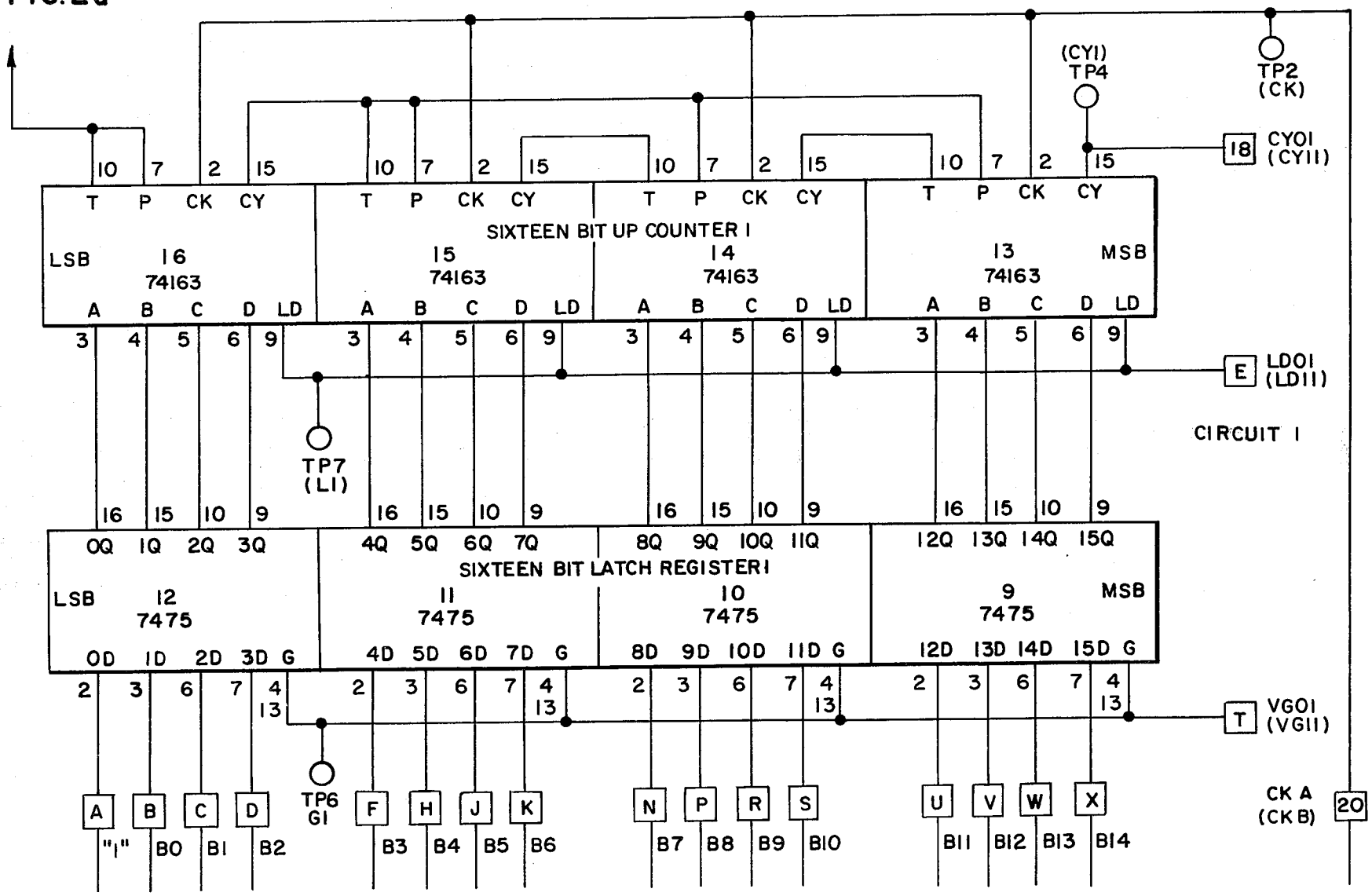
FIGS. 2A and 2B are schematic drawings of suitable voice logic circuitry.
Figure 2B:
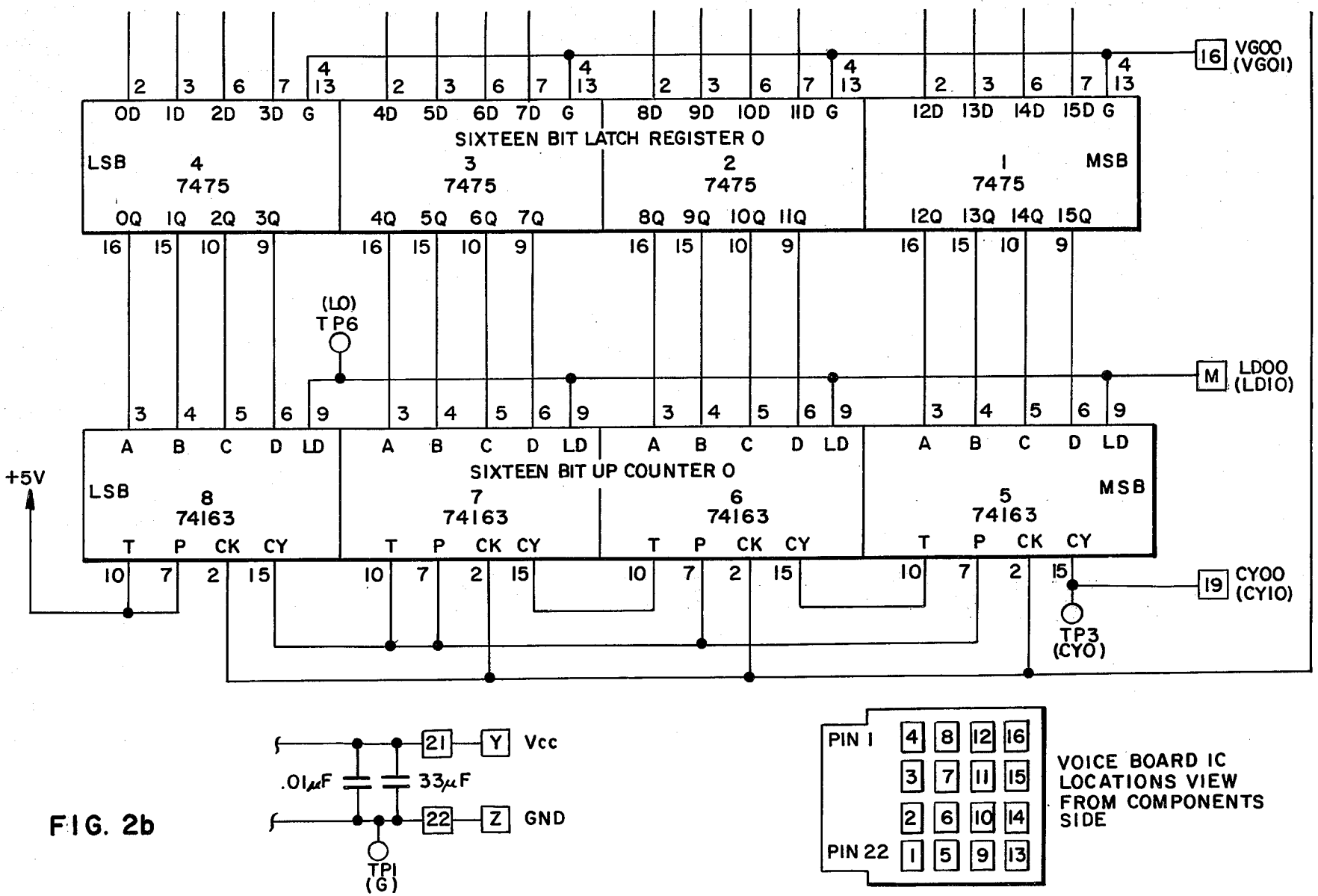
Figure 3A:
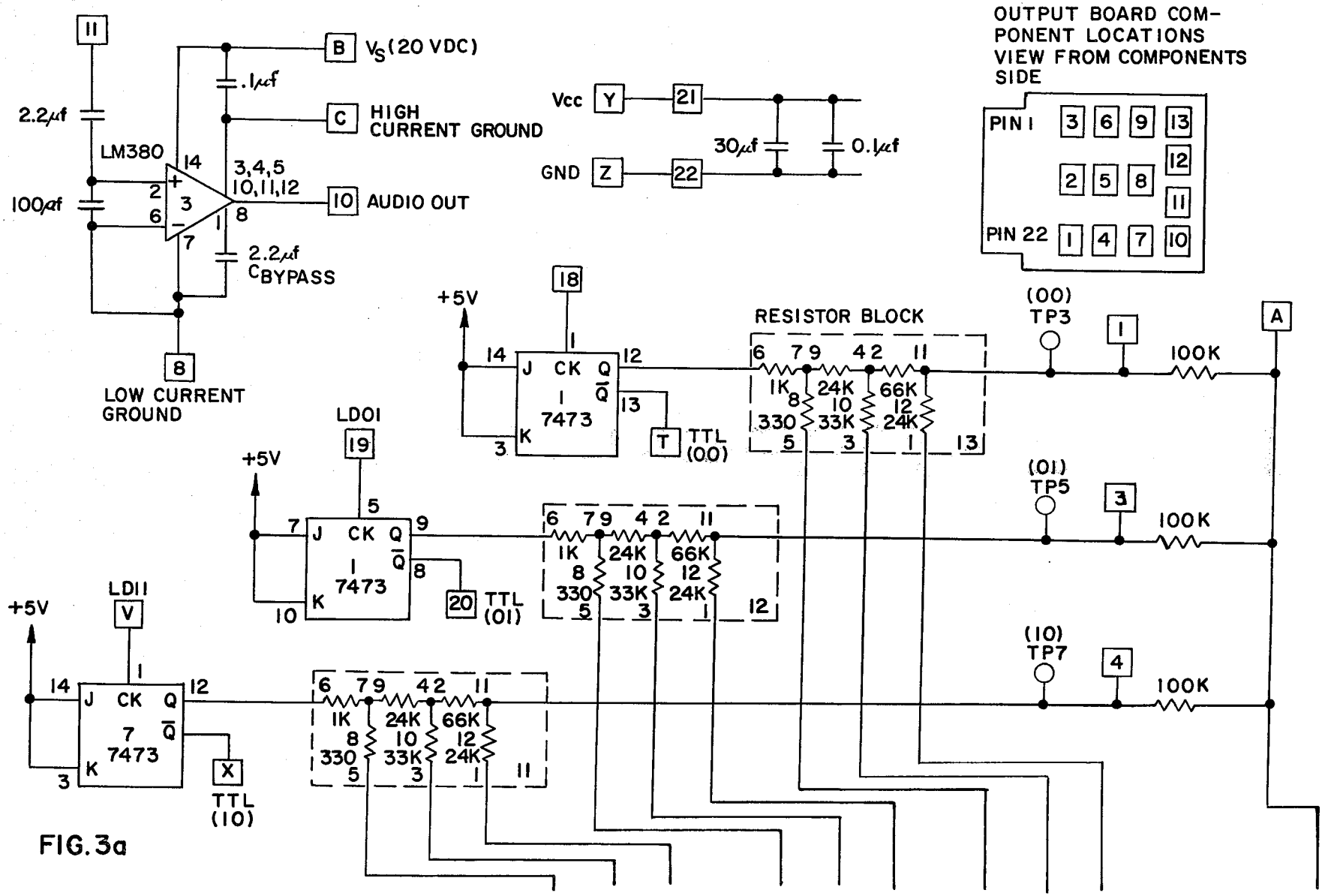
FIGS. 3A and 3B are schematic drawings of suitable output circuitry.
Figure 3B:
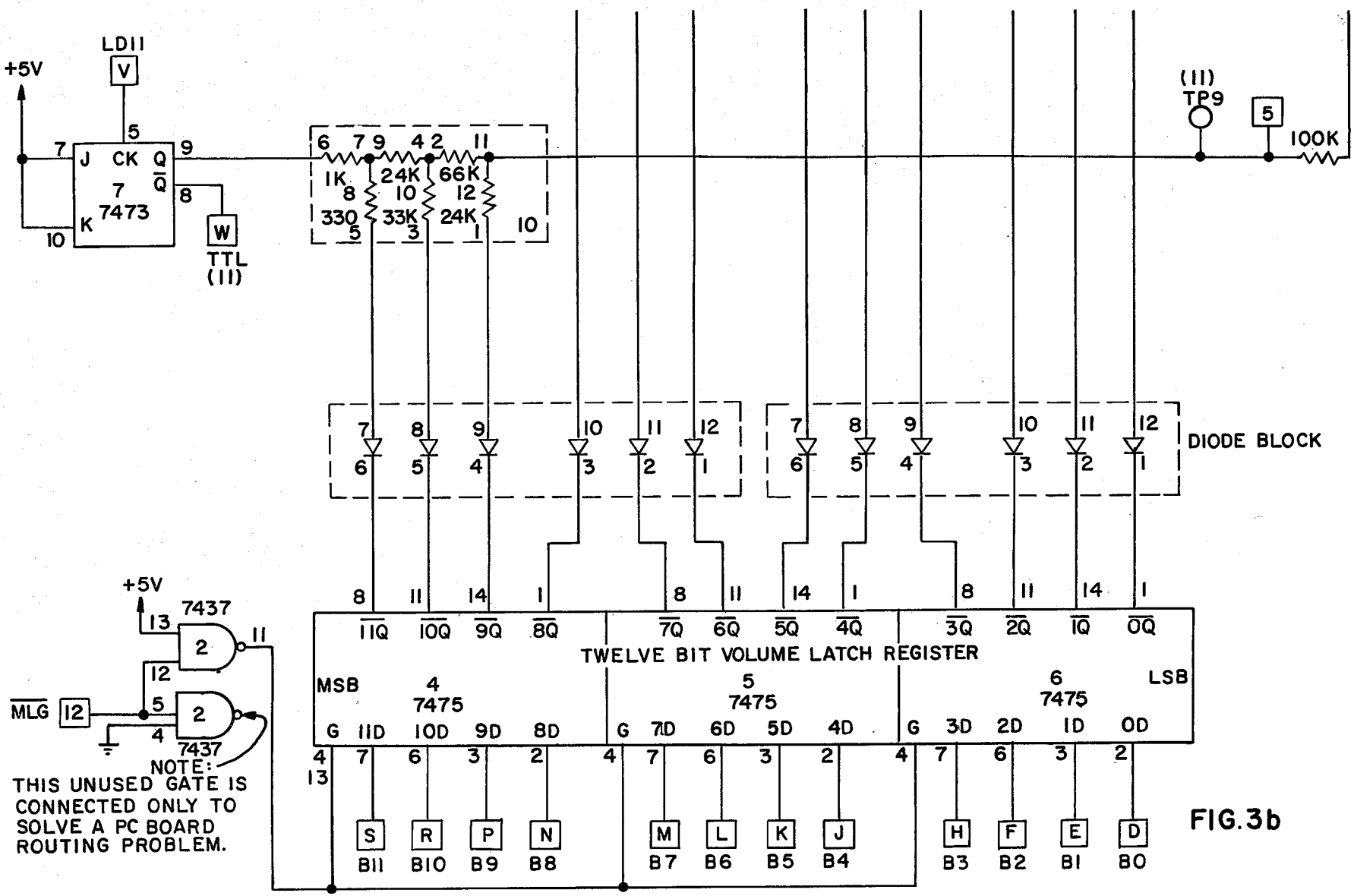
Figure 4:
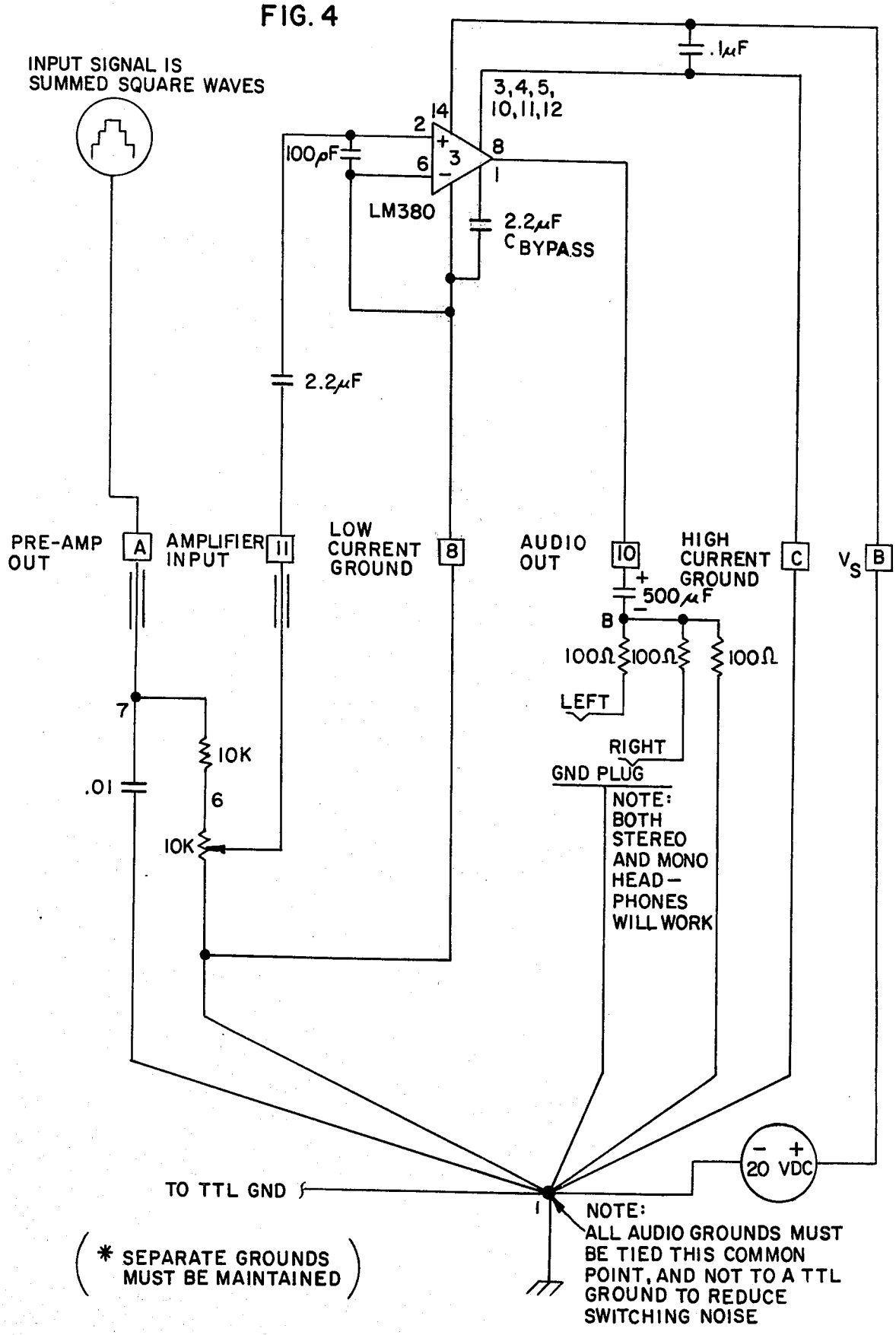
FIG. 4 is a schematic drawing of suitable audio circuitry.

Current versions of the PLATO System, for example the PLATO IV System operated in conjunction with the PLATO IV terminal, are capable of delivering 960 bits of information per second to peripheral devices connected to the terminal. The music synthesizer of this invention is designed to take advantage of this capability. The music synthesizer interprets incoming information in two distinctly different manners. First, a frame of information may be used to condition the state of the music synthesizer. This is accomplished by the control circuitry shown in FIG. 1 and the output circuitry shown in FIG. 3. In the second manner of interpretation, a frame can be used as a pitch operand and thus control the pitch of any of four individual voices. This is accomplished by the circuitry shown in FIG. 2.

PLATO IV output to the terminal is divided into 21 bit packages, which are delivered each 1/60 of a second. Sixteen of these bits can be sent to a peripheral device such as the music synthesizer. Each of these packages of information is called a frame. When an information processing device is "conditioned" the device is instructed to interpret following information in a different manner. As used herein, a voice in music is a single melody line. A voice reproduces one pitch at a time. Chords for example are built by combining voices.

The states which a frame of information uses to condition the music synthesizer may alter the number of voices to receive following information, the way that this information will be passed to these voices, and the volume at which these voices will be played.

All of the information sent to the music synthesizer is handled in a straightforward manner once it is received. The operation of the music synthesizer can be described in terms of four novel features.

The first of these novel features in handling the information necessary to reproduce music is what shall be referred to as the format of the pitch operands. As stated previously, certain 16-bit input words (one per frame) of information may be used to determine the pitch of a note to be played by an individual voice. The algorithm which is employed to determine the frequency to be reproduced is essentially that a standard frequency source contained in the music synthesizer is divided by an operand contained in the input word to yield the note frequency. This is a desirable feature because a small amount of hardware is required to produce the desired pitch. A relatively large amount of data is sent to play each note. This is a large amount of information relative to the amount of data required to name all standard musical notes. For example, the 88 notes on a piano keyboard require less than seven bits of information so that each may be assigned a unique number. By comparison, this data structure contains a unique number for each of 32767 different pitches. This structure enables the music synthesizer to play in any tuning or temperament, as well as to act as a stable tone-generating source in non-musical applications. In contrast, conventional techniques specify notes by utilizing only enough information to name the note. Systems which operate in this manner are innately more costly to build. The method of handling pitch operands is novel in that it requires that there be algorithms resident in the controlling computer which generate the mathematical inverse function to the function which the voice divider circuits perform. This method of handling is desirable in that it allows the use of low-cost hardware to generate the desired pitches.

The second novel feature of encoding the information in the music synthesizer rests on the assumption that when a narrow bandwidth channel of information, such as a telephone line, is used for control, the information will come in a predictable and uninterrupted stream from the central computer facility. The information received is processed and acted upon immediately upon its receipt by the music synthesizer. This is advantageous in that buffers to hold the information previous to processing are not necessary in the music synthesizer. This significantly reduces the cost of fabrication of the device. It also allows any feedback to an individual user to be immediate because buffers need not be filled previous to activation of the device. This is a crucial consideration in the design of a device which is to be used as a feedback effector in computer-based educational applications.

An alternate explanation of the second novel feature follows: There are programs which make up part of the PLATO IV central computer system software which provide dynamically expanding and contracting extended core storage buffers to contain pending output for any active PLATO IV terminal connected to the PLATO IV System. There is another program which outputs one frame to each of the active terminals every frame-time, namely $1/60^{th}$ of a second. An understanding of the way in which these programs function such that they maintain a buffer internal to the PLATO IV central computer and send an uninterrupted stream of information from these buffers to the PLATO IV terminals allows the design of the music synthesizer to incorporate the functions of the programs and buffers residing in the central computer system. An equivalent way of thinking of this feature is that building a hardware buffer in each music synthesizer was avoided by using, instead, a dynamically controlled buffer resident in the PLATO IV central computer system.

The third novel feature of the music synthesizer is the way in which the information necessary to describe simultaneous notes, such as a chord or note cluster, is handled. This information is time multiplexed. There are no problems associated with multiplexing musical information over wide bandwidth channels, but the channel of information coming from the PLATO IV central computer to the music synthesizer is a narrow bandwidth channel. With four voices active, the music synthesizer is operating at a theoretical limit dictated by the channel and the method of encoding pitch operands previously discussed.

In the field of psychoacoustics, it is known that human pitch perception is dependent upon the number of cycles of a tone burst which are played to a subject, as opposed to the length of time that the tone burst lasts. Most subjects detect pitch in five cycles. Since the pitch operands are multiplexed one per frame and frames are transmitted by the PLATO IV System at a rate of sixty per second, the following question arises: In worst case, how many frames of output can be sent in the time that it takes for the human aural perception to establish the individual pitches contained in a note cluster? To answer this question, it is assumed that the first pitch output is of lowest frequency and that the last pitch output is of infinite frequency. No time is required for five cycles of the highest frequency to pass. One hundred Hertz is a suitable choice for the low tone. This frequency corresponds to a pitch more than two octaves below International (440) A and approximates the tone range for left-hand piano accompaniment. It takes five centiseconds for the 100 Hz tone to produce five cycles. This is equivalent to 3/60 of a second or three frame-times. If the first tone is output at time zero, then its pitch will be perceived at a time 3 frame-times later, indicating that as many as four voices may be maintained without destroying the perception of simultaneity.

The PLATO IV music synthesizer is unique among computer-controlled music devices in that it takes advantage of this pitch perception lag technique to hide the multiplexing time of notes and in that it uses this technique to the theoretical limit. This theoretical limit has since been verified by experiment, in that note clusters composed of pitches below 100 Hz. generated by the music synthesizer from consecutive frames of output appear to begin simultaneously, while, if a subject is exposed to note clusters composed of pitches above 1 KHz, he can differentiate between the times that the individual notes begin.

The final novel feature of the music synthesizer involves the way in which musical timing is done. No hardware whatsoever is needed to do timing related to the tempo of the music being played or of the duration of the individual notes being played. Both types of timing are accomplished by counting individual PLATO IV output frames and using this stable time base (one frame each sixtieth of a second) to determine the duration of each individual note, and, therefore, to determine the tempo of music being played. This is advantageous in that the cost for hardware to determine note duration and tempo of music is eliminated. This approach is unique in that conventional computer music devices contain the hardware for at least one time base to determine note duration or tempo.

The invention has been described in detail with particular reference to certain preferred embodiments thereof, but it is understood that variations and modifications can be effected within the spirit and scope of the appended claims.

What is claimed is:

1. In a Plato System comprising a central computer and a user terminal, said system containing music information and being capable of transmitting the music information over a channel no wider than 1260 bits per second, the improvement comprising a music synthesizer electronically coupled to said system and an audio output circuit electronically coupled to the music synthesizer, said music synthesizer comprising:

(a) an electronic control circuit coupled to the Plato System;

(b) an electronic voice logic circuit coupled to the control circuit; and (c) an electronic output circuit coupled to the voice logic circuit and to the audio output circuit, said output circuit providing volume control of the audio output circuit;

said improvement in combination with said Plato System capable of reproducing the music information aurally in a plurality of voices.

2. The combination of claim 1 wherein the Plato central computer and user terminal are the Plato IV central computer and user terminal.

* * * * *